US005842291A

United States Patent [19]

Schmidt et al.

[11] Patent Number: 5,842,291

[45] Date of Patent: Dec. 1, 1998

[54] THRUST PRODUCING MULTIPLE CHANNEL-MULTIPLE CHAMBER SHOE AND BLADDER

[75] Inventors: Karl M. Schmidt, deceased, late of Woodside, Calif., by Barbara A. Schmidt, legal representative; Stuart E. Jenkins, Thousand Oaks, Calif.; Harry W. Edwards, Barrington, Ill.; George S. Cole, Pebble Beach, Calif.

[73] Assignee: Energaire Corporation, Pebble Beach, Calif.

[ * ] Notice: This patent issued on a continued prosecution application filed under 37 CFR 1.53(d), and is subject to the twenty year patent term provisions of 35 U.S.C. 154(a)(2).

The term of this patent shall not extend beyond the expiration date of Pat. No. 5,375,346.

[21] Appl. No.: 548,884

[22] Filed: Oct. 26, 1995

[51] Int. Cl.[6] ..... A43B 13/20; A43B 13/18

[52] U.S. Cl. ..... 36/29; 36/28

[58] Field of Search ..... 36/28, 29, 153, 36/3 R, 71; 5/648, 651, 652, 655.3

[56] References Cited

U.S. PATENT DOCUMENTS

| | | | |
|---|---|---|---|
| D. 321,977 | 12/1991 | Kilgore et al. | D2/320 |
| 508,034 | 11/1893 | Moore . | |
| 547,645 | 10/1895 | LaCroix . | |
| 850,327 | 4/1907 | Tauber . | |
| 1,193,608 | 8/1916 | Poulson . | |
| 1,605,985 | 11/1926 | Rasmussen . | |
| 2,080,499 | 5/1937 | Nathansohn . | |
| 3,225,463 | 12/1965 | Burnham . | |
| 3,921,313 | 11/1975 | Mahide et al. . | |
| 4,100,686 | 7/1978 | Sgarlato et al. | 36/29 |
| 4,219,945 | 9/1980 | Rudy | 36/29 |
| 4,342,157 | 8/1982 | Gilbert | 36/29 |
| 4,358,902 | 11/1982 | Cole et al. | 36/29 X |
| 4,391,048 | 7/1983 | Lutz . | |
| 4,446,634 | 5/1984 | Johnson et al. | 36/29 |
| 4,458,430 | 7/1984 | Peterson . | |
| 4,766,680 | 8/1988 | Maciel et al. . | |
| 4,845,863 | 7/1989 | Yung-Mao | 36/114 |
| 5,005,300 | 4/1991 | Diaz et al. | 36/114 |
| 5,084,987 | 2/1992 | Flemming | 36/28 |
| 5,084,988 | 2/1992 | Berger | 36/112 |
| 5,152,081 | 10/1992 | Hallenbeck et al. | 36/28 |
| 5,201,125 | 4/1993 | Shorten | 36/29 |

(List continued on next page.)

FOREIGN PATENT DOCUMENTS

| | | |
|---|---|---|
| 338266 | 11/1930 | United Kingdom . |
| 2114425 | 2/1962 | United Kingdom . |

*Primary Examiner*—B. Dayoan
*Attorney, Agent, or Firm*—Emrich & Dithmar

[57] ABSTRACT

A thrust-producing bladder for a shoe sole and heel structure is provided. The bladder includes a sole portion, a heel portion, first and second metatarsal pockets disposed in the sole portion for underlying the metatarsal ball area of a foot for which the bladder is sized, and first and second heel pockets disposed in the heel portion for underlying the heel area of a foot for which the bladder is sized. The bladder also includes a first restricted passageway providing fluid communication between the first metatarsal pocket and the first heel pocket and a second restricted passageway providing fluid communication between the second metatarsal pocket and the second heel pocket. Fluid is sealed in the pockets and passageways, whereby at rest a foot on the bladder is cushioned comfortably on the fluid in the pockets and in motion the fluid alternates between the first metatarsal pocket and the first heel pocket and between the second metatarsal pocket and the second heel pocket, so as to provide shock absorption and to produce an alternating lifting effect by the pockets which provide forward thrust both in the heel portion and in the sole portion that facilitates moving. The bladder can be disposed between a midsole and an outsole of sole and heel member of a shoe.

19 Claims, 2 Drawing Sheets

U.S. PATENT DOCUMENTS

| | | | |
|---|---|---|---|
| 5,222,311 | 6/1993 | Lin | 36/28 |
| 5,235,761 | 8/1993 | Chang | 36/3 R |
| 5,303,485 | 4/1994 | Goldston et al. | 36/137 |
| 5,353,459 | 10/1994 | Potter et al. | 36/29 X |
| 5,363,570 | 11/1994 | Allen et al. | 36/29 X |
| 5,367,792 | 11/1994 | Richard et al. | 36/114 |
| 5,375,346 | 12/1994 | Cole et al. | 36/28 |

THRUST PRODUCING MULTIPLE CHANNEL-MULTIPLE CHAMBER SHOE AND BLADDER

BACKGROUND OF THE INVENTION

1. Field of the Invention

The present invention relates to shoe constructions and, in particular, to shoe constructions having fluid filled cushioning bladders therein.

2. Description of the Prior Art

Various sole and heel constructions have been previously provided which have fluid-containing chambers. Some of these structures include a molded outer sole and heel member having pre-molded heel and metatarsal bulges projecting from the exterior surface of the member and which, respectively, define portions of heel and metatarsal chambers and a passageway connecting the chambers. While these members provide excellent cushioning and shock absorption, they sometimes cause lateral instability. Though this lateral instability can be controlled by providing stabilizing structures around the periphery of the member adjacent the bulges, or by other means, the bulges do not allow the member to have a substantially flat exterior surface. This limits the versatility of the member. For example, these bulges make it difficult to properly apply spikes for golf or baseball to these members.

In addition to having heel and metatarsal chambers formed partially at the exterior surface, heel and metatarsal chambers have been provided within the member which allow for a flat exterior surface. For example, shoes having bladders located away from the exterior surface of an outer sole and heel member and having several chambers connected by passageways have previously been provided. These bladders, however, suffer from several problems. First, they are constructed of materials that are not flexible enough to allow the force of a wearer's foot to properly cause the transfer of fluid from one chamber to another. Second, and similarly, the chambers and channels often have too great a volume and the force of a wearer's foot is only able to compress the fluid in a chamber and not both compress and properly transfer the fluid to another attached chamber. Third, the chambers of these bladders often cover too great an area, so that a wearer's foot can compress only a portion of the chamber. This causes the compressed fluid to travel to other portions of the same chamber rather than to the attached chamber. Fourth, the chambers in these bladders are often too deep. If a wearer's foot is able to fully compress such a chamber located under the wearer's heel, the wearer's heel fully drops into the cavity left by the fluid which has left the chamber. This can cause undesirable harm to the wearer's achilles tendon.

SUMMARY OF THE INVENTION

It is a general object of the invention to provide an improved shoe bladder which avoids the disadvantages of prior bladders while affording additional structural and operational advantages.

An important feature is the provision of a shoe bladder which is of relatively simple and economical construction.

A still further feature of the invention is the provision of a shoe bladder which allows a shoe outer sole and heel member to have a substantially flat external surface, which provides improved lateral stability, and which allows the member to be used for varied applications.

Yet another important feature of the invention is the provision of a shoe bladder of the type which includes fluid-filled pockets and communicating passageways therebetween, which optimize the cushioning effect of the fluid.

These and other features of the invention are attained by providing a thrust-producing bladder for a shoe sole and heel structure including a sole portion, a heel portion, first and second metatarsal pockets disposed in the sole portion underlying the metatarsal ball area of a foot for which the bladder is sized, and first and second heel pockets disposed in the heel portion underlying the heel area of a foot for which the bladder is sized. The bladder also includes a first restricted passageway providing fluid communication between the first metatarsal pocket and the first heel pocket, and a second restricted passageway providing fluid communication between the second metatarsal pocket and the second heel pocket. The bladder also includes fluid sealed in the pockets and passageways, whereby at rest a foot on the bladder is cushioned comfortably on the fluid in the pockets, and whereby in motion the fluid alternates between the first metatarsal pocket and the first heel pocket and between the second metatarsal pocket and the second heel pocket, so as to provide shock absorption and to produce an alternating lifting effect by the pockets which provide forward thrust both in the heel portion and in the sole portion that facilitates moving.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
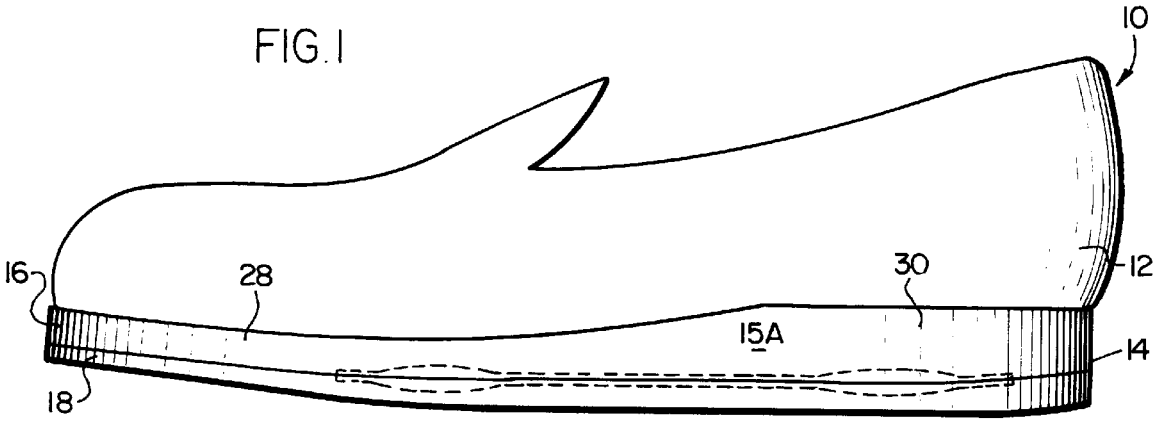
FIG. 1 is a side elevation view of a shoe of the present invention with the hidden bladder shown in broken line.
Figure 7:
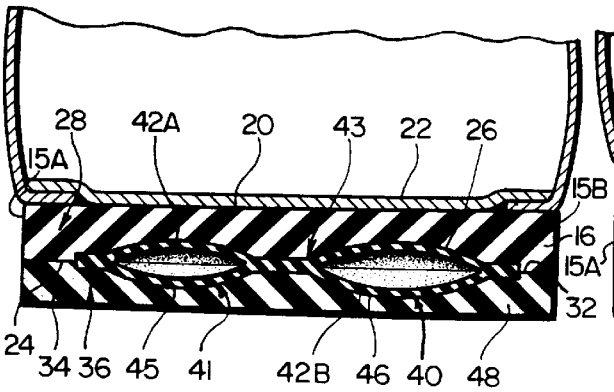
FIG. 7 is an enlarged, fragmentary, sectional view taken generally along the line 7—7 in FIG. 5.

As seen in FIG. 1, there is illustrated a shoe 10 having a conventional upper or last 12. The shoe 10 also includes an outer sole and heel member 14. The member 14 has an inside edge 15A and an outside edge 15B (see FIGS. 7 and 8). The member 14 includes a midsole 16 overlying an outsole 18.

Figure 2:
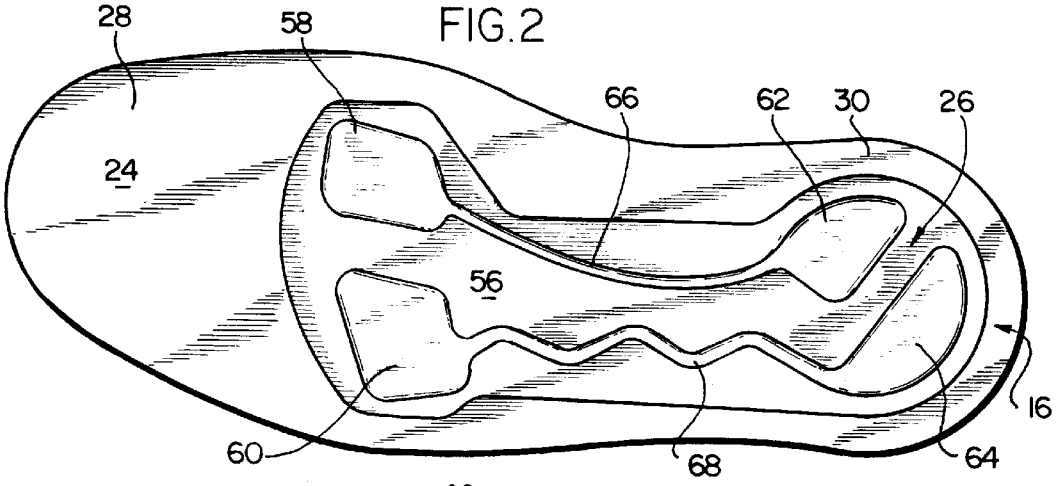
FIG. 2 is a bottom plan view of the midsole of the shoe of FIG. 1.

The midsole 16 has a generally wedge shape whereby the shoe 10 is referred to as being of the "wedge type". Referring to FIGS. 2 and 6–8, the midsole 16 has an upwardly facing surface 20 which faces a sock liner 22. The midsole 16 also has a downwardly facing surface 24 which faces the outsole 18. The midsole 16 also includes a midsole cavity formation 26 opening at the downwardly facing surface 24. As is discussed in greater detail below, the midsole 16 may be a molded piece made out of a generally light-weight, non-porous material, such as polyurethane or EVA. The midsole 16, as seen in FIGS. 1 and 2, has a sole portion 28 located under the sole of a wearer's foot and a heel portion 30 located under the heel of a wearer's foot.

Figure 4:
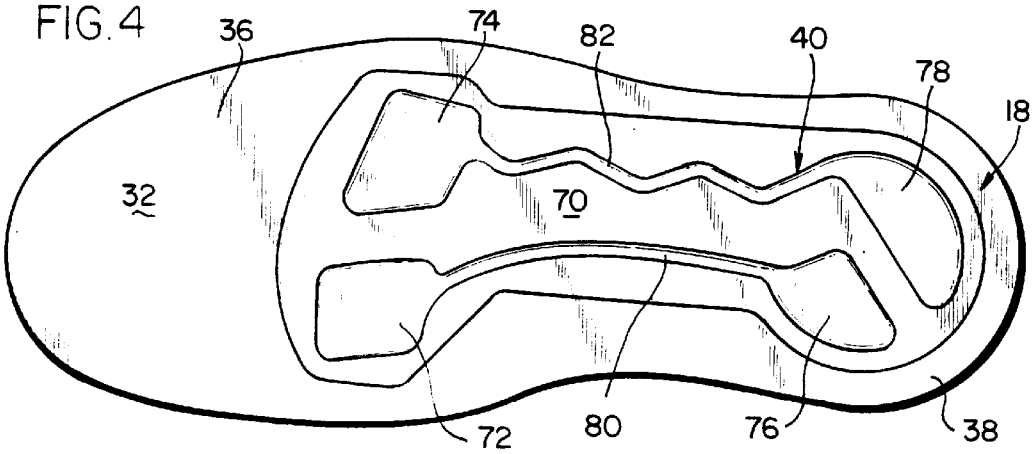
FIG. 4 is a top plan view of the outsole of the shoe of FIG. 1.
Figure 5:
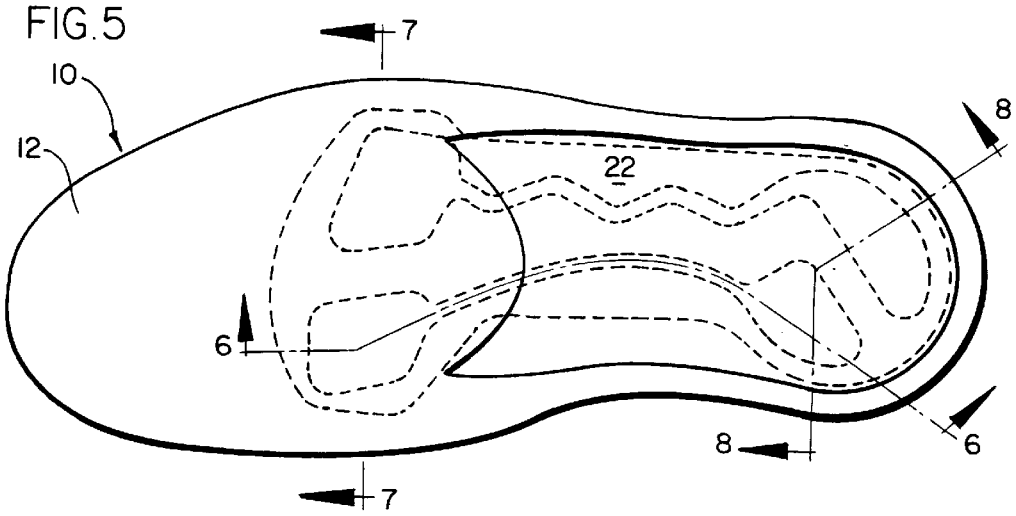
FIG. 5 is a top plan view of the shoe of FIG. 1.
Figure 6:
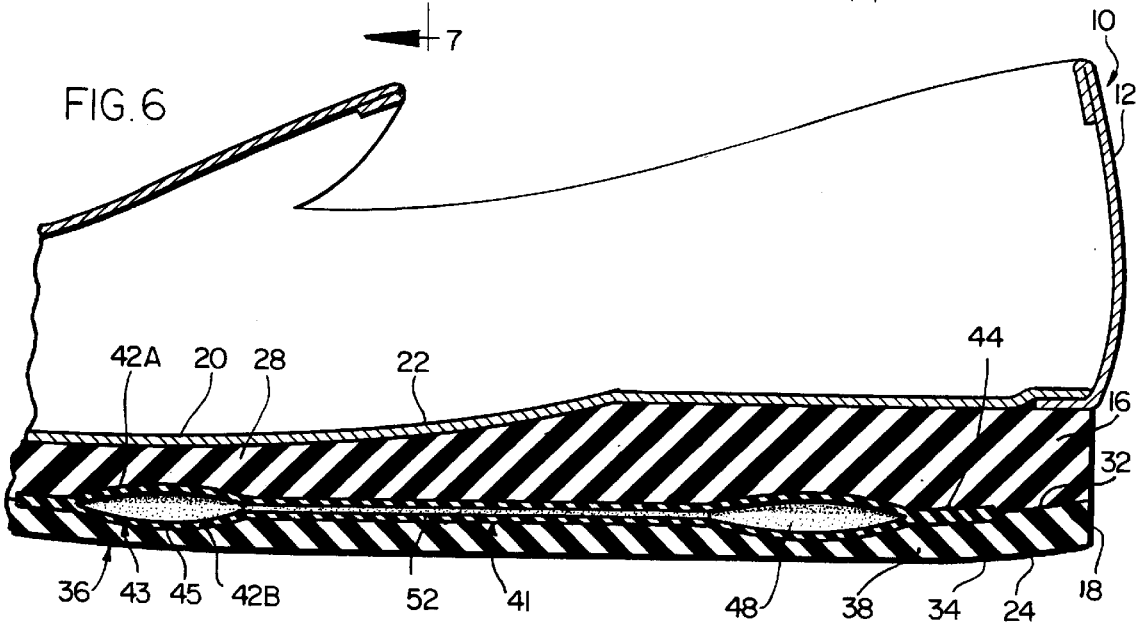
FIG. 6 is an enlarged, fragmentary, sectional view taken generally along the line 6—6 in FIG. 5.

Referring also to FIG. 4, the outsole 18 is an elongated, thin member of one-piece molded construction, preferably made of a highly flexible, wear-resistant material, such as rubber. A very useful rubber is a rubber sold under the brand name INDY 500 and made by the Goodyear Tire & Rubber Company.

Figure 8:
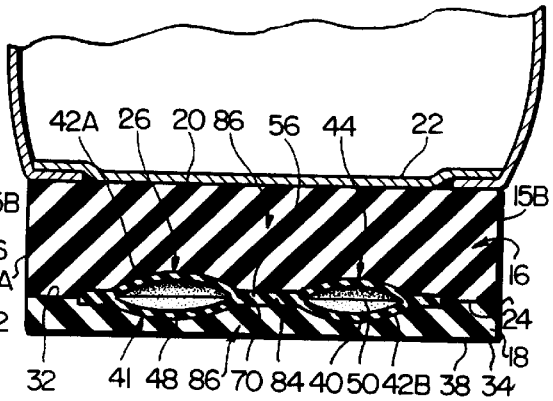
FIG. 8 is an enlarged, fragmentary, sectional view taken generally along the line 8—8 in FIG. 5.

As seen in FIGS. 1, 4 and 8, the outsole 18 has an interior surface 32, which faces the midsole 16, and a substantially flat exterior surface 34, which is subject to constant engagement with the pavement or underlying support surface, which will hereinafter be referred to as the "ground". The outsole 18 also has a sole portion 36 located under the sole portion 28 of the midsole 16 and the sole of a wearer's foot and a heel portion 38 located under the heel portion 30 of the midsole 16 and the heel of a wearer's foot (see FIG. 6). The outsole 18 also has an outsole cavity formation 40 opening at the interior surface 32 and underlying the midsole cavity formation 26. An adhesive is disposed between a portion of the downwardly facing surface 24 of the midsole 16 and a portion of the interior surface 32 of the outsole 18 to fixedly secure the two together.

Figure 3:
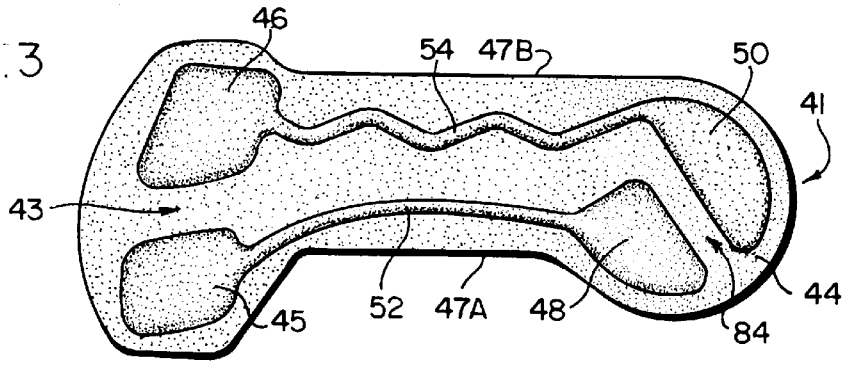
FIG. 3 is a top plan view of a bladder contained in the shoe of FIG. 1.

Referring also to FIG. 3, the member 14 also includes a thrust producing bladder 41 disposed between the interior surface 32 of the outsole 18 and the downwardly facing surface 24 of the midsole 16. An upper portion 42A of the bladder 41 is disposed in the midsole cavity formation 26 of the midsole 16 and a lower portion 42B of the bladder 41 is disposed in the outsole cavity formation 40 of the outsole 18. The bladder 41 may be a one-piece, blow-molded construction made out of a flexible, fluid-impervious material, such as a rubber or a rubberized plastic.

The bladder 41, as best seen in FIGS. 3 and 6–8, includes a sole portion 43 disposed between the sole portion 28 of midsole 16 and the sole portion 36 of the outsole 18 and a heel portion 44 disposed between the heel portion 30 of the midsole 16 and the heel portion 38 of the outsole 18. The bladder 41 also includes laterally spaced-apart inside and outside metatarsal pockets 45, 46 molded in the sole portion 43 and being positioned to underlie the metatarsal ball area of a wearer's foot for which the shoe 10 is sized. Each of the pockets 45, 46 is generally in the shape of a parallelogram. The bladder 41 also has an inside edge 47A and an outside edge 47B.

The bladder 41, as seen in FIGS. 3 and 8, also includes laterally spaced-apart inside and outside heel pockets 48, 50 molded in the heel portion 44, which underlie the heel area of a wearer's foot for which the shoe 10 is sized. The inside heel pocket 48 is generally triangularly shaped and is positioned under the laterally inner edge of the wearer's heel and adjacent the inside edge 47A of the bladder 41. The outside heel portion 50 has a generally semicircular shape and is positioned under the laterally outer side of a wearer's heel and adjacent the outside edge 47B of the bladder 41. The majority of the outside heel pocket 50 is disposed rearwardly of the inside heel pocket 48.

Also molded into the bladder 41 are elongated inside and outside restricted passageways 52, 54. Inside restricted passageway 52 follows a generally curved path adjacent the inside edge 47A of the bladder 41 and provides fluid communication between the forward end of the inside heel pocket 48 and the inside metatarsal pocket 45. Outside restricted passageway 54 follows a generally zig-zag path and provides fluid communication between the forward end of outside heel portion 50 and the outside metatarsal pocket 46.

A fluid, usually air at atmospheric pressure, is trapped in the pockets 45, 46, 48, 50 and the passageways 52, 54. In use, when a wearer is standing in the shoe 10, the air in the pockets 45, 46, 48, 50 provide a cushioning effect. In walking or running, the heel portion 38 of the outsole 18 first comes in contact with the ground and the heel of a wearer's foot exerts pressure on the midsole 16 above heel pockets 48, 50. The force of the ground contacting the heel portion 38 of the outsole 18 and the force of a wearer's heel on the midsole 16 cause the air in the heel pockets 48, 50 to be compressed and, respectively, forced forwardly through passageways 52, 54 into the metatarsal pockets 45, 46.

As the heel portion 38 of the outsole 18 lifts off the ground, the sole portion 36 of the outsole 18 contacts the ground. The force of the ground contacting the sole portion 36 of the outsole 18 under the metatarsal pockets 45, 46 and the force of a wearer's foot on the midsole 16 above the metatarsal pockets 45, 46 cause the air in the metatarsal pockets 45, 46 to compress and be, respectively, forced back through the passageways 52, 54 into heel pockets 48, 50 to give a lifting effect. Thus in walking and running, the air moves back and forth between the inside metatarsal pocket 45 and the inside heel pocket 48 and between the outside metatarsal pocket 46 and the outside heel pocket 50 to give an alternating lifting effect and provide thrust, both at the metatarsal ball area and the heel area, that facilitates walking and running.

As discussed above, the metatarsal pockets 45, 46 underlie the metatarsal ball area of a wearer's foot for which the shoe 10 is sized. It is preferred that these pockets 45, 46, or the majority thereof, underlie only the wearer's metatarsal ball area and that no portion of these pockets 45, 46 be in front of the metatarsal ball area. This placement ensures that the air, when it is compressed in the pockets 45, 46, will travel to the heel pockets 48, 50 rather than to forward areas of the pockets 45, 46 where it will not properly provide a lifting or cushioning effect.

Additionally, the passageways 52, 54 are sized as small as possible to provide proper fluid transfer between the metatarsal pockets 45, 46 and the heel pockets 48, 50. Preferably, the passageways 52, 54 are about 0.125 inches in diameter or less, or have a cross-sectional area of about 0.012 inches or less.

The heel pockets 48, 50 do not communicate with each other, nor do the metatarsal pockets 45, 46. Thus, the air therein can only substantially be forced in forward and rearward directions, so that there is no lateral or side-to-side air movement therebetween, which aids in preventing lateral instability.

Also, the zig-zag path of passageway 54 also in preventing lateral instability. More particularly, the area of the exterior surface 34 of the outsole 18 under outside heel pocket 50 will strike the ground prior to the area of the exterior surface 34 of the outsole 18 under inside heel pocket 48. This would normally cause the air in outside heel pocket 50 to be compressed and sent to outside metatarsal pocket 46 prior to the air in inside heel pocket 48 being compressed and forced to metatarsal pocket 45. This non-simultaneous compression of the heel pockets 48, 50 and/or transfer could cause lateral instability by making the shoe 10 roll inwardly or supinate, if the outside metatarsal pocket 46 is caused to be filled with air significantly quicker than the inside metatarsal pocket 45. The zig-zag shape of passageway 54 prevents or alleviates this problem by providing a longer length path between the pockets 50 and 46 than between the pockets 48 and 45. Thus, more time is required for the air forced from the outside heel pocket 50 to reach the outside metatarsal pocket 46, thereby allowing metatarsal pockets 45, 46 to be filled with air substantially at or near the same time.

Since the area of the exterior surface 34 of the outsole 18 under outside heel pocket 50 strikes the ground first, the outside edge of a wearer's heel is subject to a greater shock than the inside edge of the wearer's heel. The outside heel pocket 50, therefore, preferably has a greater volume than the inside heel pocket 48 to absorb this greater shock.

As seen in FIGS. 2–4 and 6–8, both the midsole cavity formation 26 and the outsole cavity formation 40 are each shaped to match the contours of the bladder 41 and to receive a portion of the bladder 41 therein.

As seen in FIGS. 2 and 6–8, midsole cavity formation 26 has a surface 56 disposed above the downwardly facing surface 24 of the midsole 16 surrounding the midsole cavity formation 26. The midsole cavity formation 26 also includes an inside metatarsal pocket cavity 58, an outside metatarsal pocket cavity 60, an inside heel pocket cavity 62, an outside heel pocket cavity 64, an inside restricted passageway cavity 66, and an outside restricted passageway cavity 68, which all open at the surface 56 and, respectively, receive portions of the bladder pockets and passageways 45, 46, 48, 50, 52, and 54.

As seen in FIGS. 4 and 6–8, the outside cavity formation 40 is a mirror image of the midsole cavity formation 26. The outside cavity formation 40 includes a surface 70 disposed below the interior surface 32 of the outsole 18 surrounding the outsole cavity formation 40. Like the midsole cavity formation 26, the outside cavity formation 40 also includes an inside metatarsal pocket cavity 72, an outside metatarsal pocket cavity 74, an inside heel pocket cavity 76, an outside heel pocket cavity 78, an inside restricted passageway cavity 80 and an outside restricted passageway cavity 82 which all open at the surface 70 and which, respectively, receive portions of the bladder pockets and passageways 45, 46, 48, 50, 52, and 54.

As seen in FIG. 3, there is a portion 84 of the bladder 41 which separates the inside heel pocket 48 and the outside heel pocket 50. As seen in FIG. 8, the surface 56 of the midsole cavity formation 26 overlies and contacts portion 84 and the surface 70 of the outsole cavity formation 40 underlies and contacts portion 84. Thus, a portion 86 of member 14, disposed between the inside heel pocket 48 and the outside heel pocket 50 and running from the surface 70 of the midsole 16 to the exterior surface 34 of outsole 18, is solid and aids, while and after the air in the heel pockets 48, 50 has been forced forward, in preventing a wearer's heel from dropping down too deeply and thereby damaging the wearer's achilles tendon. A wearer's heel which overlies portion 86 and both heel pockets 48, 50 will drop only about the distance between the top of heel pockets 48, 50 and the surface 56, rather than the entire depth of the heel pockets 48, 50.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A bladder comprising:

a flexible and resilient body having a generally planar base having an overall area and including first and second medial portions, the body having a sole portion and a heel portion;

laterally spaced-apart first and second metatarsal pockets respectively having areas in the plane of the base and disposed in the sole portion, the first and second metatarsal pockets projecting outwardly from the plane of the base and being separated by the first medial portion of the base;

laterally spaced-apart first and second heel pockets respectively having areas in the plane of the base and disposed in the heel portion, the first and second heel pockets projecting outwardly from the plane of the base and being separated by the second medial portion of the base, wherein the sum of the areas of the first and second heel pockets and the first and second metatarsal pockets is substantially less than the overall area of the base;

a first restricted passageway providing fluid communication between the first metatarsal pocket and the first heel pocket;

a second restricted passageway providing fluid communication between the second metatarsal pocket and the second heel pocket; and fluid sealed in the pockets and passageways.

2. The bladder of claim 1, wherein the bladder is a one-piece member.

3. The bladder of claim 2, wherein the bladder is blow-molded.

4. The bladder of claim 1, wherein the first and second heel pockets have first and second volumes and the first volume is greater than the second volume.

5. The bladder of claim 4, and further including an inside lateral edge and an outside lateral edge wherein the first heel pocket is located closer to the outside lateral edge than the second heel pocket.

6. The bladder of claim 5, wherein the first restricted passageway has a zig-zag shape.

7. A shoe sole and heel structure comprising:

an outsole having interior and exterior surfaces;

a midsole overlying the outsole, the midsole having an outsole-facing surface and a foot-facing surface;

means for attaching the interior surface of the outsole to the outsole-facing surface of the midsole to form a member having a sole portion and a heel portion; and a thrust-producing bladder disposed between the midsole and the outsole, the bladder including laterally spaced-apart first and second metatarsal pockets disposed in the sole portion underlying the metatarsal ball area of a foot for which the bladder is sized wherein a first portion of at least one of the midsole and outsole is disposed between the first and second metatarsal pockets, laterally spaced-apart first and second heel pockets disposed in the heel portion underlying the heel area of a foot for which the member is sized wherein a second portion of at least one of the midsole and outsole is disposed between the first and second heel pockets, a first restricted passageway having an inner diameter providing fluid communication between the first metatarsal pocket and the first heel pocket, the first heel pocket, the first metatarsal pocket and the first restricted passageway defining a first fluid system having a length, a second restricted passageway having an inner diameter providing fluid communication between the second metatarsal pocket and the second heel pocket, the second heel pocket, the second metatarsal pocket and the second restricted passageway defining a second fluid system having a length, wherein the first fluid system is separated along its entire length from the second fluid system by a distance substantially greater than the inner diameter of the first restricted passageway, and fluid sealed in the pockets and passageways, whereby at rest a foot on the member is cushioned comfortably on the fluid in the pockets and in motion the fluid alternates between the first metatarsal pocket and the first heel pocket and between the second metatarsal pocket and the second heel pocket, so as to provide shock absorption and to produce an alternating lifting effect by the pockets which provide forward thrust both in the heel portion and in the sole portion that facilitates moving.

8. The structure of claim 7, wherein the outsole has an outsole cavity formation opening at the interior surface and at least a portion of the bladder is disposed within the outsole cavity formation.

9. The structure of claim 7, wherein the midsole has a midsole cavity formation opening at the outsole facing surface and at least a portion of the bladder is disposed within the midsole cavity formation.

10. The structure of claim 9, wherein the midsole cavity formation includes first and second separated heel cavities respectively having at least portions of the first and second pockets disposed therein and separated first and second metatarsal cavities respectively having at least portions of the first and second metatarsal pockets disposed therein.

11. The structure of claim 10, wherein the outsole has first and second heel cavities opening at the interior surface and respectively disposed below the first and second heel cavities of the midsole.

12. A shoe comprising:

a foot-receiving upper and an elongated sole and heel structure secured to the upper;

the structure including:

an inside lateral edge and an outside lateral edge;

an outsole having interior and exterior surfaces;

a midsole overlying the outsole, the midsole having an outsole-facing surface and a foot-facing surface;

means for attaching the interior surface of the outsole to the outsole-facing surface of the midsole to form a member having a sole portion and a heel portion; and a thrust-producing bladder disposed between the midsole and the outsole, the bladder including laterally spaced-apart first and second metatarsal pockets disposed in the sole portion underlying the metatarsal ball area of a foot for which the bladder is sized wherein a first portion of at least one of the midsole and outsole is disposed between the first and second metatarsal pockets, laterally spaced-apart first and second heel pockets disposed in the heel portion underlying the heel area of a foot for which the member is sized, the first heel pocket being disposed closer to the outside lateral edge and than the second heel pocket and rearward of the second heel pocket, wherein a second portion of at least one of the midsole and outsole is disposed between the first and second heel pockets, a first restricted passageway providing fluid communication between the first metatarsal pocket and the first heel pocket, a second restricted passageway providing fluid communication between the second metatarsal pocket and the second heel pocket, and fluid sealed in the pockets and passageways, whereby at rest a foot in the shoe is cushioned comfortably on the fluid in the pockets and in motion the fluid alternates between the first metatarsal pocket and the first heel pocket and between the second metatarsal pocket and the second heel pocket, so as to provide shock absorption and to produce an alternating lifting effect by the pockets which provide forward thrust both in the heel portion and in the sole portion that facilitates moving.

13. The shoe of claim 12, wherein the bladder is a one-piece member.

14. The shoe of claim 13, wherein the bladder is blow-molded.

15. The shoe of claim 12, and further including an inside lateral edge and an outside lateral edge wherein the first heel pocket is located closer to the outside edge than the second heel pocket.

16. The shoe of claim 15, wherein the first restricted passageway has a zig-zag shape.

17. The structure of claim 12, wherein the outsole has an outsole cavity formation opening at the interior surface and at least a portion of the bladder is disposed within the outsole cavity formation.

18. The structure of claim 12, wherein the midsole has a midsole cavity formation opening at the outsole facing surface and at least a portion of the bladder is disposed within the midsole cavity formation.

19. The structure of claim 18, wherein the midsole cavity formation includes first and second separated heel cavities respectively having at least portions of the first and second pockets disposed therein, and separated first and second metatarsal cavities having at least portions of the first and second metatarsal pockets disposed therein.

* * * * *

UNITED STATES PATENT AND TRADEMARK OFFICE

CERTIFICATE OF CORRECTION

PATENT NO. : 5,842,291

DATED : December 1, 1998

INVENTOR(S) : Karl M. Schmidt et al.

It is certified that error appears in the above-identified patent and that said Letters Patent is hereby corrected as shown below:

On the title page, item[54] and Col. 1, line 3, Delete "And" .

Signed and Sealed this

Twenty-second Day of June, 1999

*Attest:*

Q. TODD DICKINSON

*Attesting Officer*

*Acting Commissioner of Patents and Trademarks*